US006427734B1

(12) United States Patent
Chiang

(10) Patent No.: US 6,427,734 B1
(45) Date of Patent: Aug. 6, 2002

(54) WOOD PLANING MACHINE WITH A TIGHTENING UNIT

(76) Inventor: Pei-Lieh Chiang, No. 12, Nan-Ping Rd., Nan Dist., Taichung City (TW)

( * ) Notice: Subject to any disclaimer, the term of this patent is extended or adjusted under 35 U.S.C. 154(b) by 0 days.

(21) Appl. No.: 09/992,391

(22) Filed: Nov. 6, 2001

Related U.S. Application Data

(63) Continuation-in-part of application No. 09/824,501, filed on Apr. 2, 2001, which is a continuation-in-part of application No. 09/741,553, filed on Dec. 19, 2000, now abandoned.

(51) Int. Cl.[7] ..... B27C 1/00

(52) U.S. Cl. ..... 144/130; 74/89.28; 144/117.1; 403/309

(58) Field of Search ..... 74/89, 89.2, 89.21, 74/89.22, 89.23, 89.28; 144/114.1, 116, 117.1, 129, 130; 403/384, 399, 341, 343, 309

(56) References Cited

U.S. PATENT DOCUMENTS 2,642,902 A * 6/1953 Carey ..... 144/129
4,436,126 A 3/1984 Lawson ..... 144/117.1
4,456,042 A * 6/1984 Clark et al. ..... 144/129
5,176,190 A * 1/1993 Miyamoto et al. ..... 144/117.1
6,269,853 B1 * 8/2001 Chang ..... 144/130

* cited by examiner

*Primary Examiner*—W. Donald Bray
(74) *Attorney, Agent, or Firm*—Ladas & Parry

(57) ABSTRACT

A wood planing machine includes a base, four hollow posts extending upright from the base and formed with slots, four screw rods disposed in the posts, four sprockets connected respectively to the screw rods, a chain engaging the sprockets, a cutter carriage including a pair of carriage seats mounted on the posts, four threaded members mounted adjustably on the carriage seats and having sector-shaped threaded portions that threadedly engage the screw rods, and four eccentric members mounted rotatably on the threaded members. Each eccentric member includes a shaft and an eccentric wheel that constantly engages a respective threaded member and that is rotatable between first and second engaging positions in which the respective threaded member is moved upwardly and downwardly.

2 Claims, 13 Drawing Sheets

WOOD PLANING MACHINE WITH A TIGHTENING UNIT

CROSS-REFERENCE TO RELATED APPLICATION

This application is a Continuation-in-part of U.S. patent application Ser. No. 09/824,501, filed Apr. 2, 2001 which is a CIP of Ser. No. 09/741,553, filed on Dec. 19, 2000 and is now abandoned.

BACKGROUND OF THE INVENTION

1. Field of the Invention

This invention relates to a wood planing machine, more particularly to a wood planing machine with a tightening unit for preventing loosening of a cutter carriage thereof during a planing operation.

2. Description of the Related Art

FIGS. 1 and 2 illustrate a conventional wood planing machine 10 disclosed in U.S. Pat. No. 5,771,949. The wood planing machine 10 includes a base 11 with two pairs of upstanding posts 12 disposed at the corners of the base 11 for supporting a cutter carriage 13 thereon, a height adjusting unit for adjusting height of the cutter carriage 13 relative to the base 11 via a handle 16 which is mounted on a top end of the wood planing machine 10, and a carriage locking mechanism 20 for positioning the cutter carriage 13 on the posts 12. The cutter carriage 13 cooperates with the base 11 to confine a wood passageway therebetween for passage of a workpiece 17, and includes a pair of opposite threaded castings. The height adjusting unit includes a pair of screw rods 14 extending upright from and disposed at two opposite sides of the base 11 between the posts 12 for rotating about axes defined by the screw rods 14, and an assembly of sprockets and a chain connected to the screw rods 14. The screw rods 14 threadedly engage the castings of the cutter carriage 13 so as to move the cutter carriage 13 upwardly and downwardly along the posts 12. The locking mechanism 20 is operable for providing a clamping force to hold the cutter carriage 13 on the posts 12 after the cutter carriage 13 is moved to a desired position by operation of the screw rods 14.

The wood planing machine 10 is disadvantageous in that since there are clearances between engaged teeth of the screw rods 14 and the castings of the cutter carriage 13, vibration of the cutter carriage 13 and clashing between the castings of the cutter carriage 13 and the screw rods 14 tend to occur during operation of the wood planing machine 10. Moreover, the vibration of the cutter carriage 13 has an adverse affect on the precision of the planed workpiece.

SUMMARY OF THE INVENTION

Therefore, it is an object of the present invention to provide a wood planing machine with a tightening unit that is capable of overcoming the drawbacks described above.

Accordingly, a wood planing machine of this invention comprises: a generally rectangular base having four corners; four parallel hollow posts that extend upright from the four corners of the base, respectively, and that are formed with elongated slots extending along lengths of the posts, respectively; four screw rods respectively disposed in the posts, and rotatable about axes defined by the screw rods, each of the screw rods including an engaging portion accessible via the slot in the respective one of the posts, the engaging portion having upper and lower helical surfaces; four sprockets disposed underneath the base and connected respectively to bottom ends of the screw rods; a chain engaging the sprockets so as to synchronize rotations of the screw rods; a cutter carriage including a pair of parallel carriage seats, each of which is transverse to and is mounted movably on two adjacent ones of the posts, and each of which includes top and bottom plates and two opposite side plates that interconnect the top and bottom plates and that are respectively formed with openings confronting the slots in the respective ones of the posts; four threaded members mounted respectively on the side plates of the carriage seats, each of the threaded members including a bracket plate mounted adjustably on a respective one of the side plates, and a sector-shaped threaded portion projecting from the bracket plate through the opening in the respective one of the side plates to threadedly engage the engaging portion of a respective one of the screw rods so as to permit the carriage seats to be moved simultaneously along the posts when the screw rods rotate synchronously, the bracket plate of each of the threaded members being formed with an engaging hole defined by a hole-confining wall, the threaded portion of each of the threaded members having upper and lower helical surfaces, the hole-confining wall of the bracket plate of each of the threaded members having top and bottom wall portions; and a tightening unit including four eccentric members that are mounted rotatably and respectively on the bracket plates of the threaded members, each of the eccentric members including a rotatable shaft and an eccentric wheel that extends radially from and that is eccentric relative to the rotatable shaft, that is inserted in and that constantly and rotatably engages the top and bottom wall portions of the hole-confining wall of the bracket plate of a respective one of the threaded members, and that is rotatable together with the rotatable shaft between a first engaging position, in which, the eccentric wheel moves the respective one of the threaded members upwardly relative to a respective one of the screw rods so as to permit engagement between the upper helical surface of the threaded portion of the respective one of the threaded members and the lower helical surface of the engaging portion of the respective one of the screw rods, and a second engaging position, in which, the eccentric wheel moves the respective one of the threaded members downwardly relative to the respective one of the screw rods so as to permit engagement between the lower helical surface of the threaded portion of the respective one of the threaded members and the upper helical surface of the engaging portion of the respective one of the screw rods.

BRIEF DESCRIPTION OF THE DRAWINGS

In drawings which illustrate an embodiment of the invention.

DETAILED DESCRIPTION OF THE PREFERRED EMBODIMENT

Figure 1:
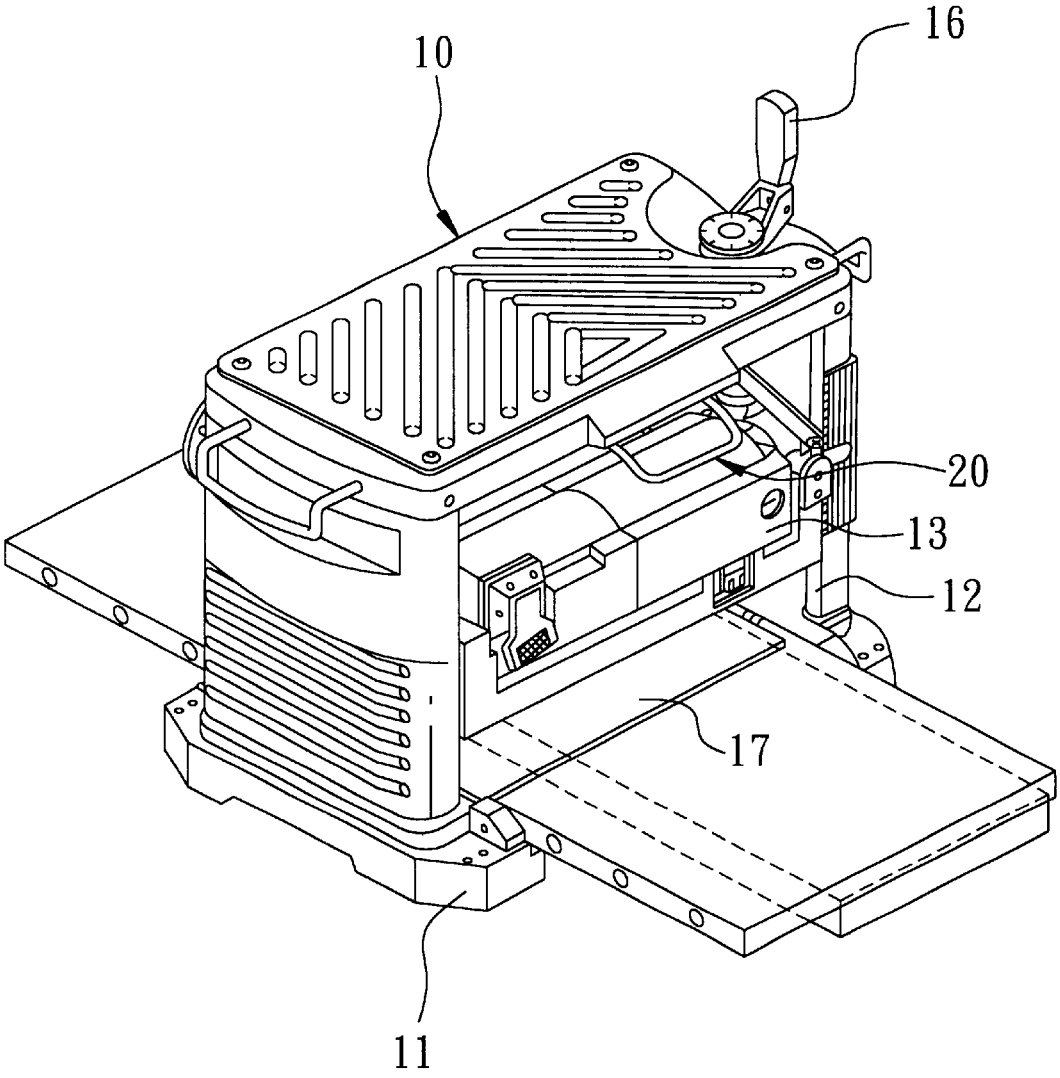
FIG. 1 PRIOR ART
FIG. 1 is an assembled perspective view of a conventional wood planing machine.
Figure 2:
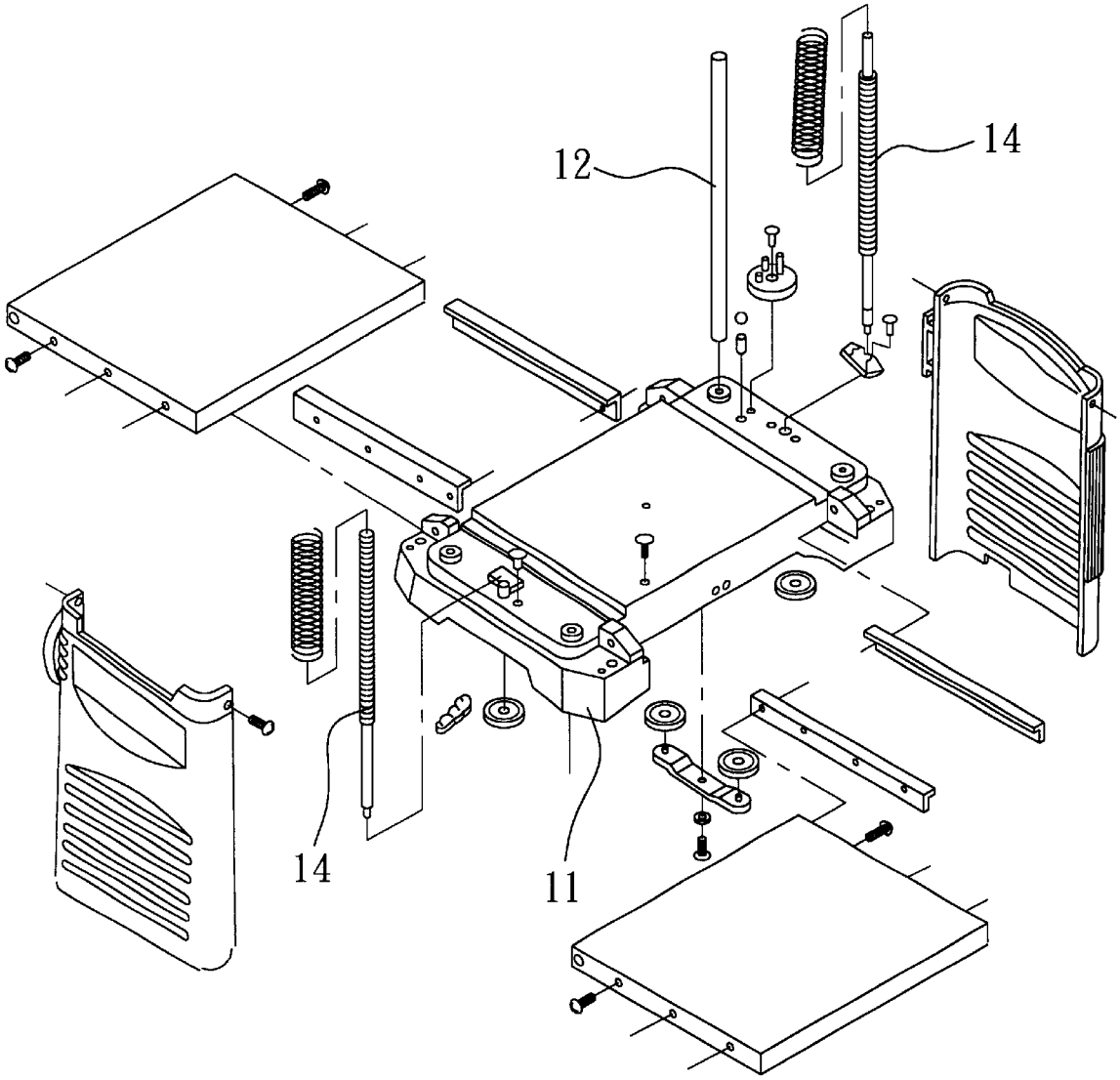
FIG. 2 PRIOR ART
FIG. 2 is a fragmentary exploded perspective view of the wood planing machine of FIG. 1.
Figure 3:
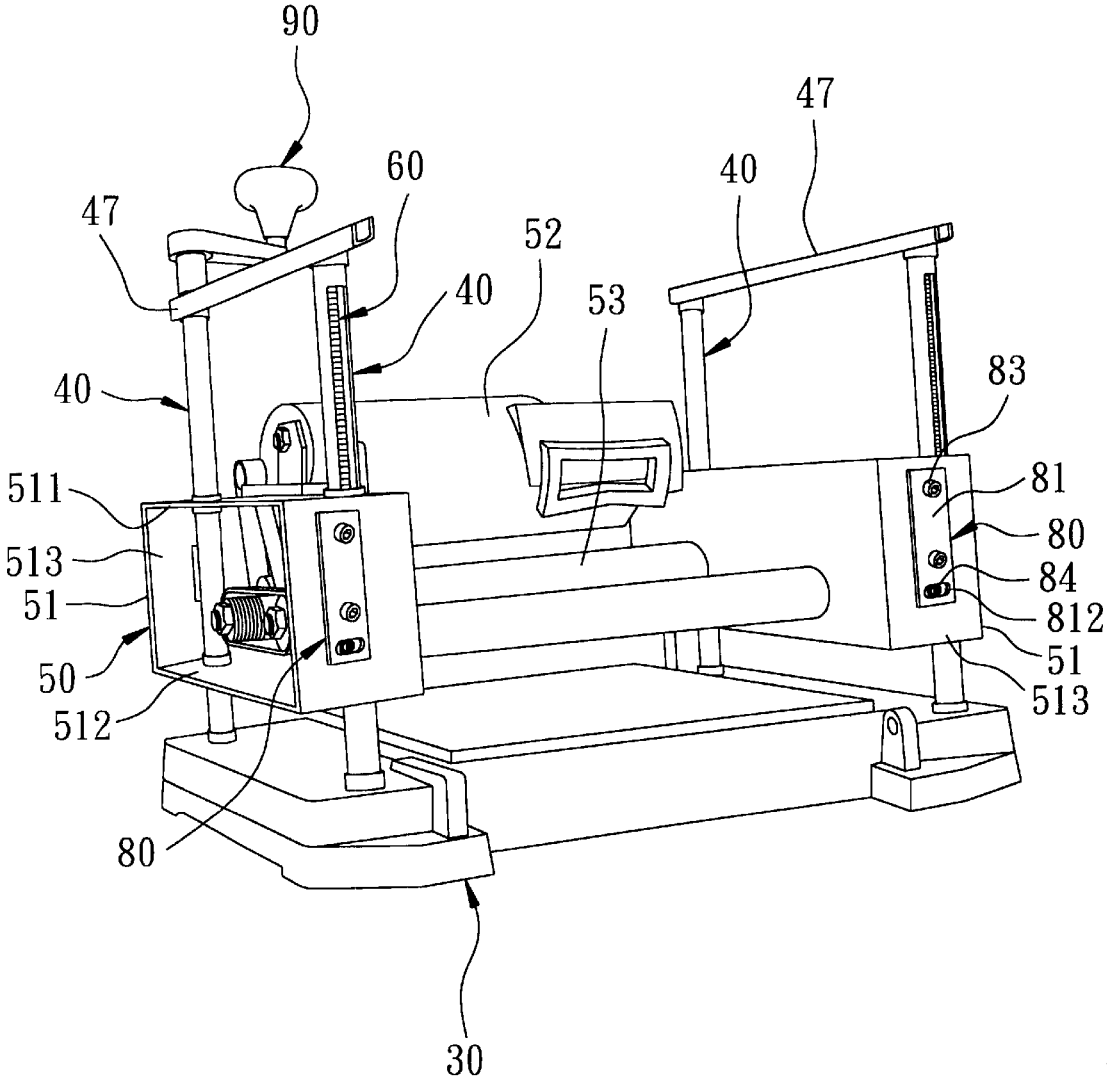
FIG. 3 is a perspective view of a wood planing machine embodying this invention.

FIGS. 3 to 7 illustrate a wood planing machine embodying this invention. The wood planing machine includes: a generally rectangular base 30 having four corners; four parallel hollow posts 40 respectively extending upright from the four corners of the base 30 and formed with elongated slots 44 that extend along lengths of the posts 40, respectively; four screw rods 60 respectively disposed in the posts 40 and rotatable about axes defined by the screw rods 60, each of the screw rods 60 having an engaging portion 60' accessible via the slot 44 in the respective post 40, the engaging portion 60' having upper and lower helical surfaces 601, 602; four bearings 43 secured to the base 30 via positioners 32 and respectively sleeved on the screw rods 50; four sprockets 71 disposed underneath the base 30 and connected respectively to bottom ends 61 of the screw rods 60 (see FIG. 6); a chain 72 engaging the sprockets 71 so as to synchronize rotations of the screw rods 60; a handle 90 connected to a top end of one of the screw rods 60 to actuate rotation of the screw rods 60; a cutter carriage 50 including a pair of parallel carriage seats 51, each of which is transverse to and is mounted movably on two adjacent ones of the posts 40, and each of which includes top and bottom plates 511, 512 and two opposite side plates 513 that interconnect the top and bottom plates 511, 512, and that are respectively formed with openings 56 confronting the slots 44 in the respective ones of the posts 40, the posts 40 and the screw rods 60 extending through the top and bottom plates 511, 512; four upper sleeves 55 secured to the top plates 511 and sleeved on the posts 40, respectively; four lower sleeves 54 secured to the bottom plates 512 and sleeved on the posts 40, respectively; a motor 52 mounted on the cutter carriage 50 between the carriage seats 51; a rotary cutter 53 mounted on the cutter carriage 50 and driven by the motor 52 for planing a wooden workpiece; and four threaded members 80 mounted adjustably and respectively on the side plates 513.

Each of the threaded members 80 includes a bracket plate 81 mounted adjustably on a respective side plate 513 via screw means 83 extending through the bracket plate 81 and the respective side plate 513, and a sector-shaped threaded portion 82 projecting from the bracket plate 81 through a respective opening 56 in the respective side plates 513 to threadedly engage the engaging portion 60' of a respective one of the screw rods 60 so as to permit the carriage seats 51 to be moved simultaneously along the posts 40 when the screw rods 60 rotate synchronously, and to be held firmly at a desired height relative to the base 30 by engagement of the screw rods 60 and the threaded portions 82 upon stopping rotation of the screw rods 60.

Each sprocket 71 includes a sleeve portion 711 sleeved on and secured to the bottom end 61 of the respective screw rod 60 via a positioner 73 and screw means 74. A groove 611 is formed in the bottom end 61 of each screw rod 60. The sleeve portion 711 of each sprocket 71 has an inner tongue 712 projecting into and engaging the groove 611 in the bottom end 61 of the respective screw rod 60 so that each sprocket 71 is rotatable with the respective screw rod 60.

Two spaced apart non-adjustable and adjustable sprockets 75, 76 are disposed between the pairs of the sprockets 71, and engage the chain 72 for adjusting tension of the latter so as to permit smooth transmission among the screw rods 60 and the sprockets 71. The adjustable sprocket 76 is mounted on a plate 77 which, in turn, is mounted adjustably on a bottom side of the base 30.

A pair of parallel supporting beams 47 interconnect top ends of the pairs of the posts 40, and cooperate with the posts 40 to support the weight of the assembly of the cutter carriage 50, the motor 52, and the rotary cutter 53. The bracket plate 81 of each of the threaded members 80 is formed with an engaging hole 812 defined by a hole-confining wall 813. The threaded portion 82 of each of the threaded members 80 has upper and lower helical surfaces 821, 822. The hole-confining wall 813 of the bracket plate 81 of each of the threaded members 80 has top and bottom wall portions.

Figure 4:
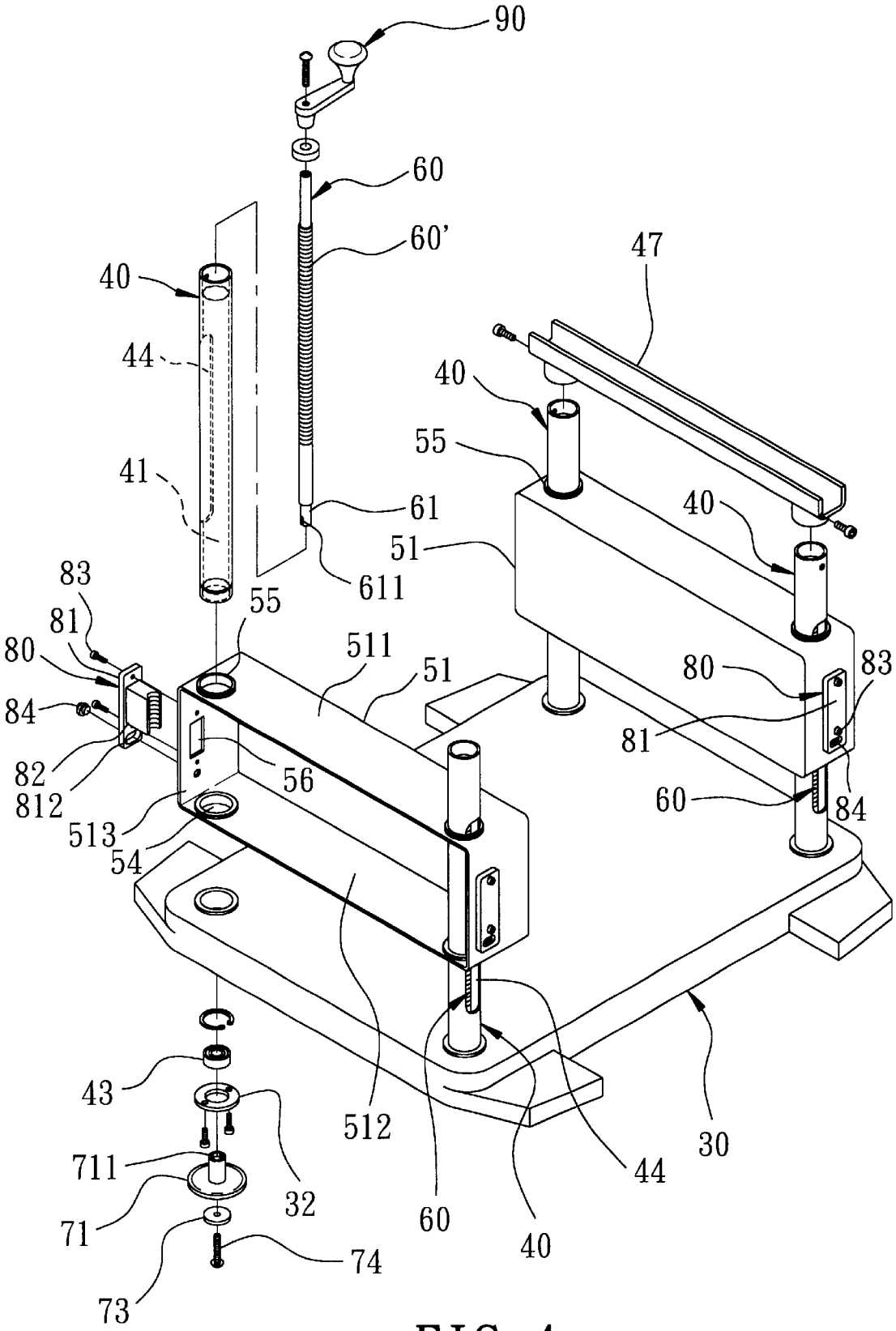
FIG. 4 is a partly exploded perspective view showing a height adjusting unit of the wood planing machine of FIG. 3.
Figure 5:
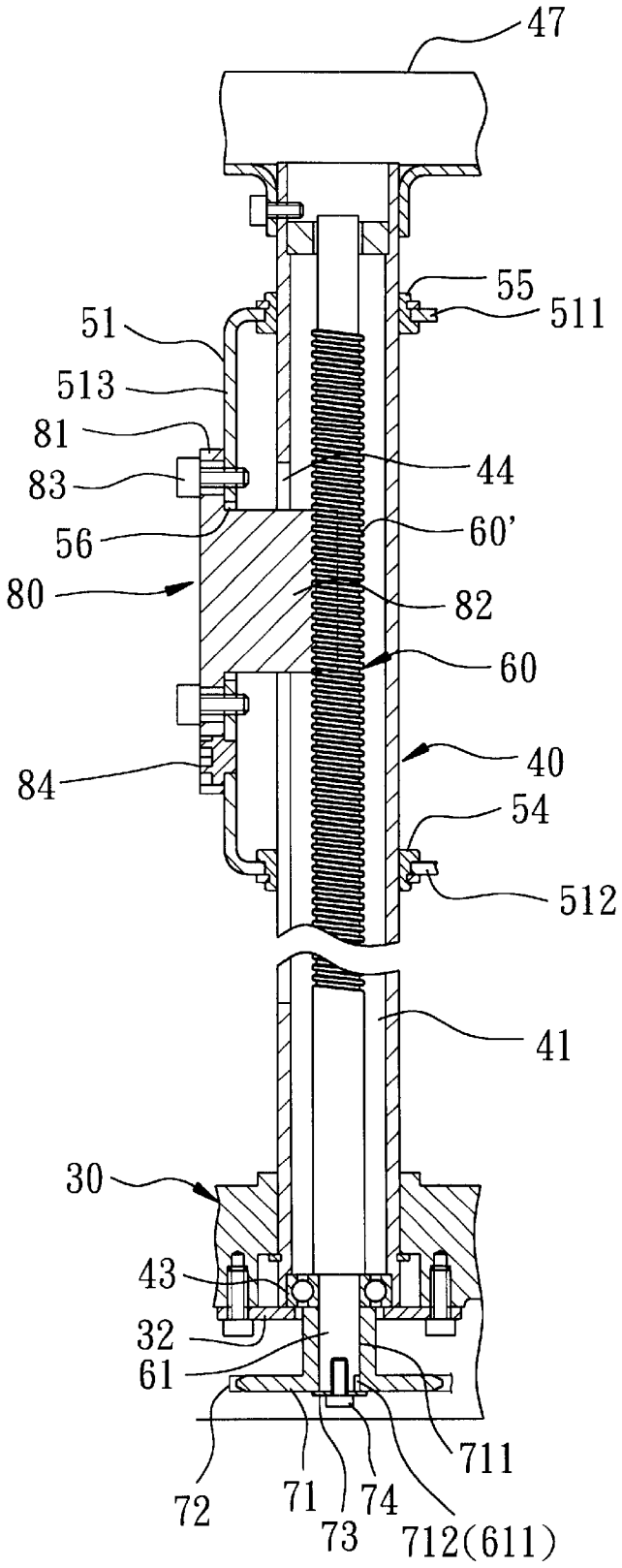
FIG. 5 is a partly cross-sectional side view of the height adjusting unit of the wood planing machine of FIG. 3.
Figure 6:
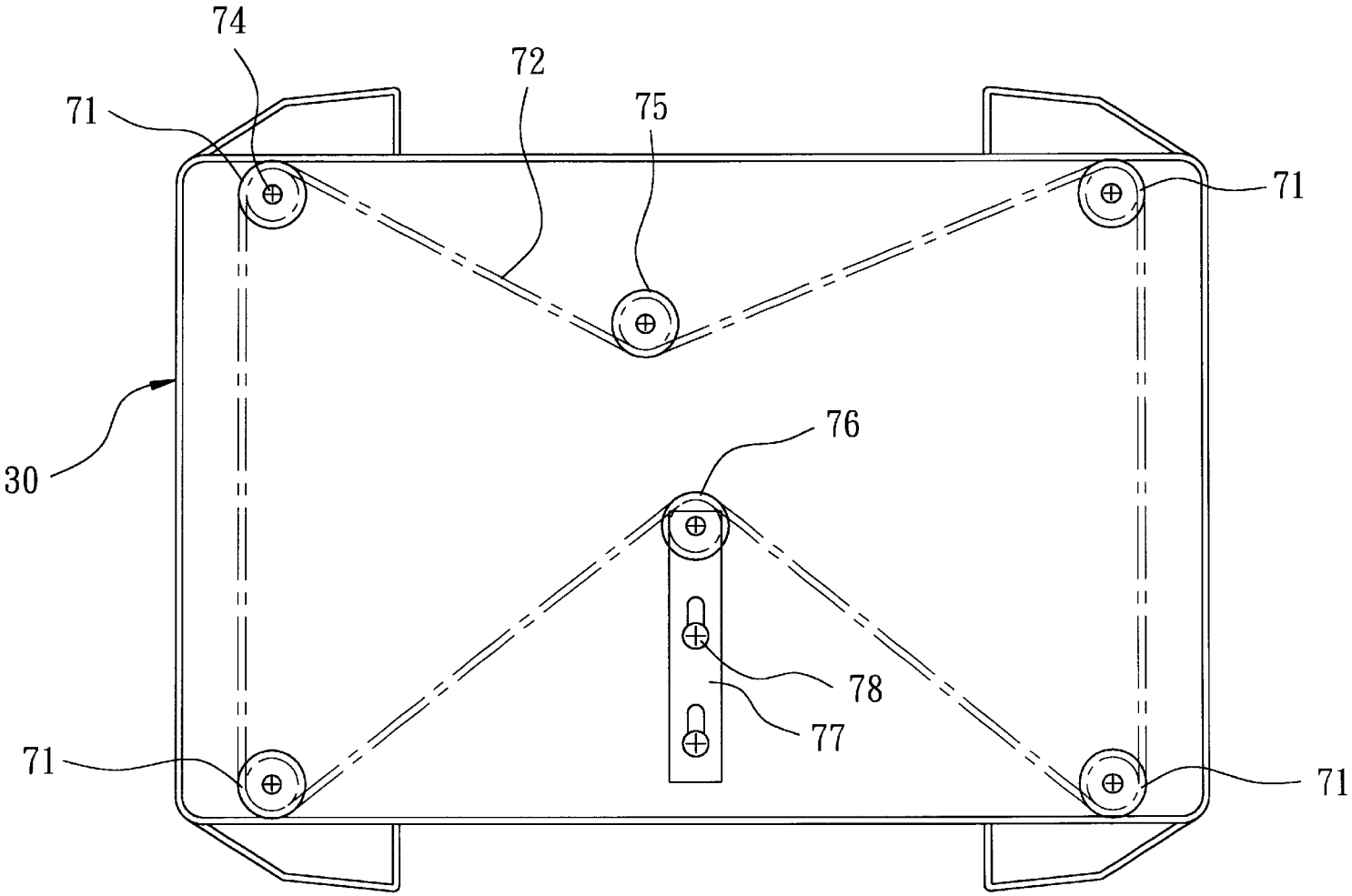
FIG. 6 is a bottom view of the wood planing machine of FIG. 3.
Figure 7:
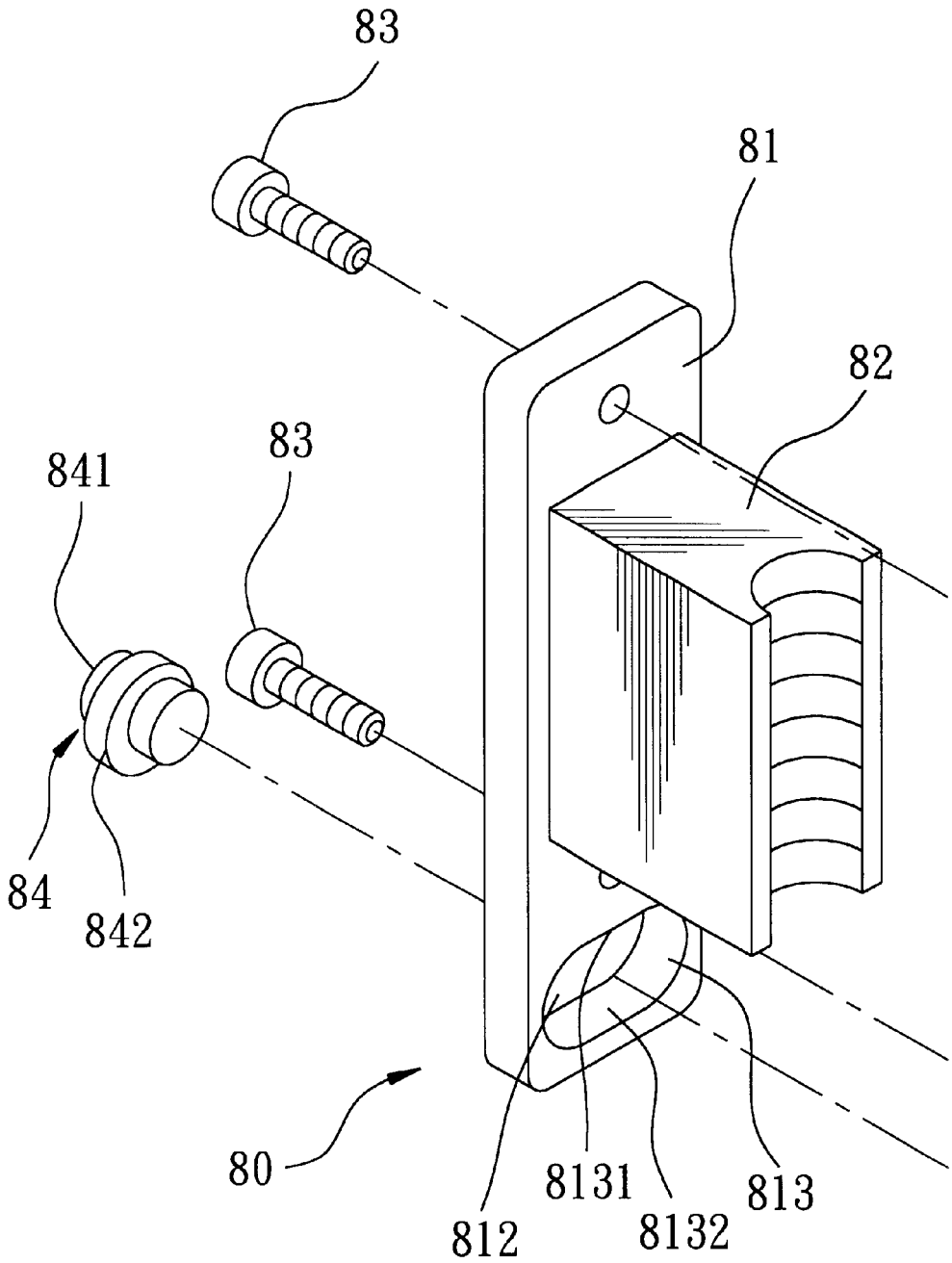
FIG. 7 is an exploded view to illustrate how an eccentric member of a tightening unit engages a threaded member of the wood planing machine of FIG. 3.
Figure 8A:
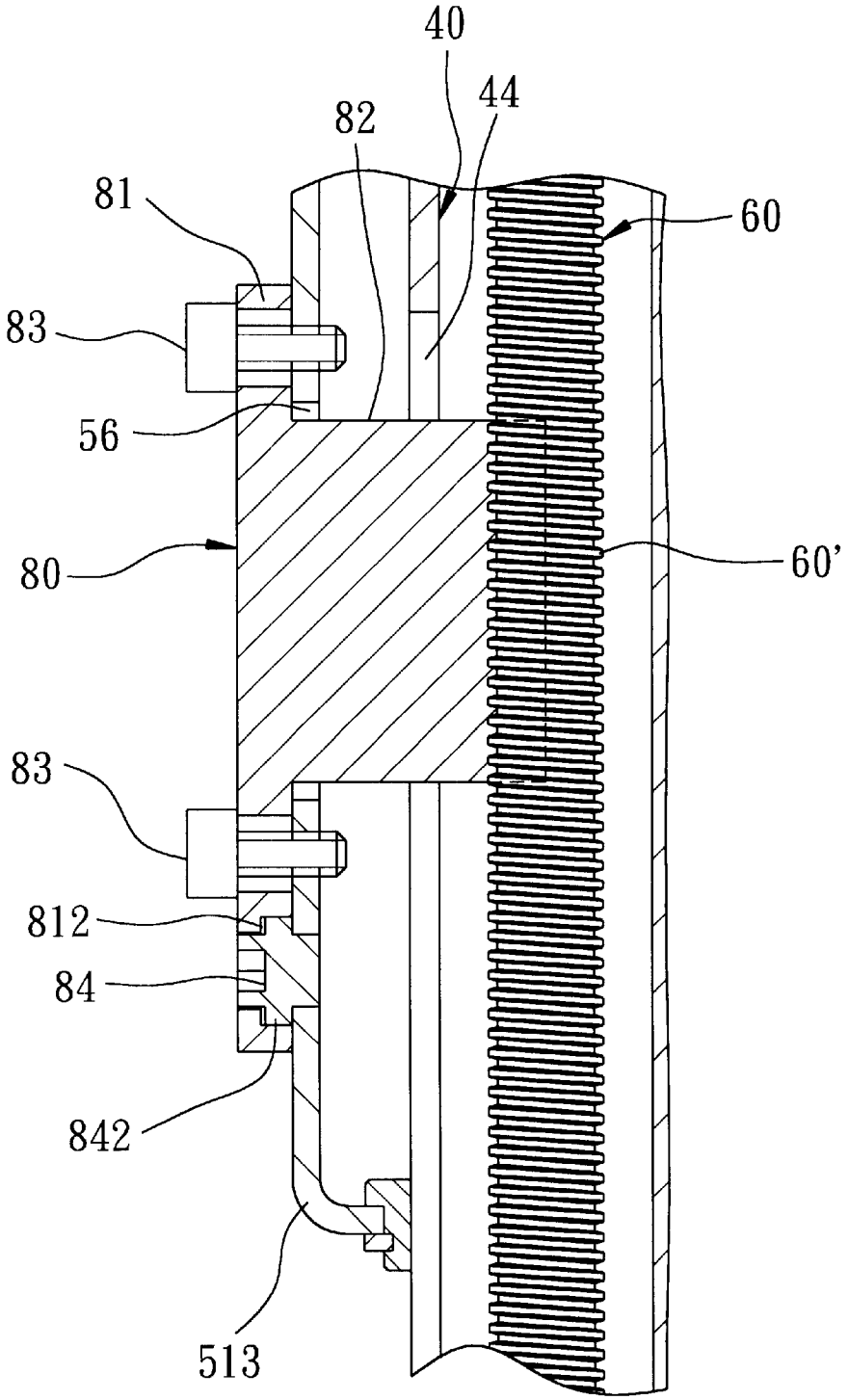
FIGS. 8A to 8C are fragmentary views to illustrate the eccentric member in a first engaging position with respective to the threaded member.
Figure 8B:
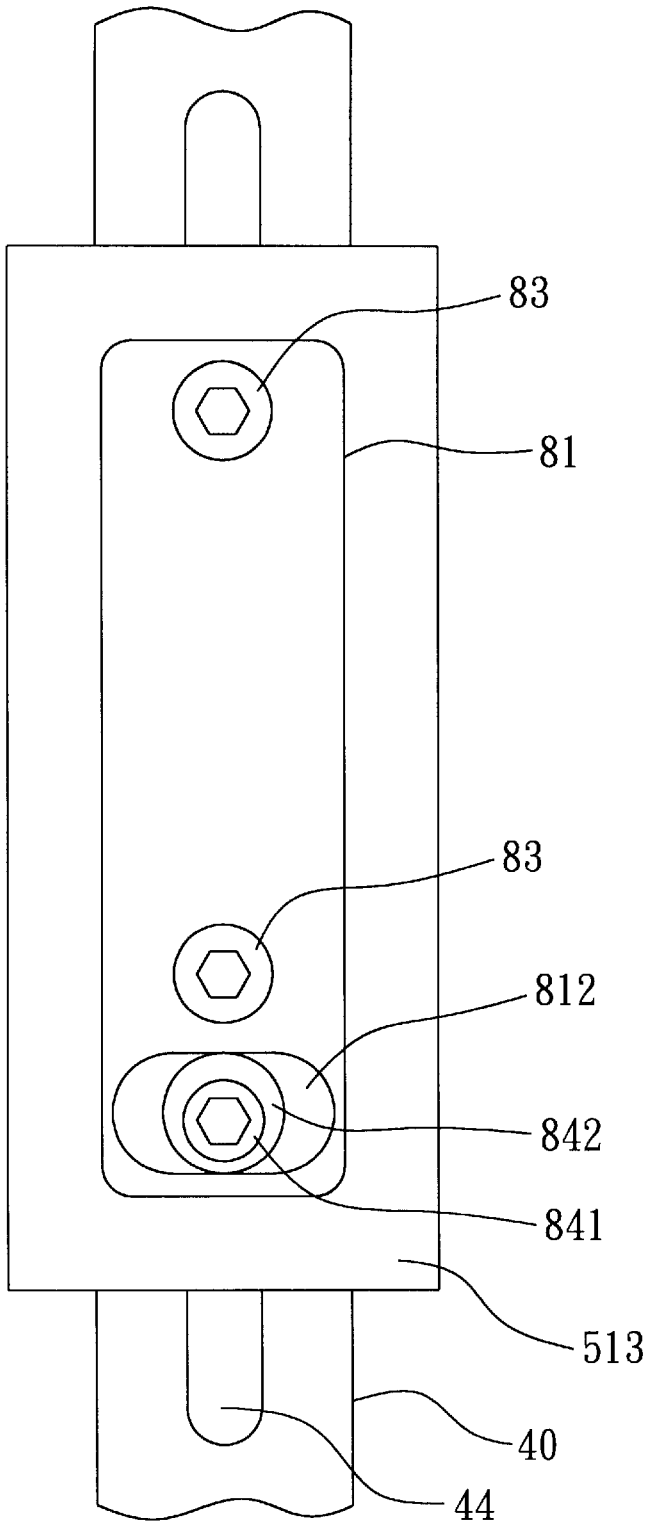
Figure 8C:
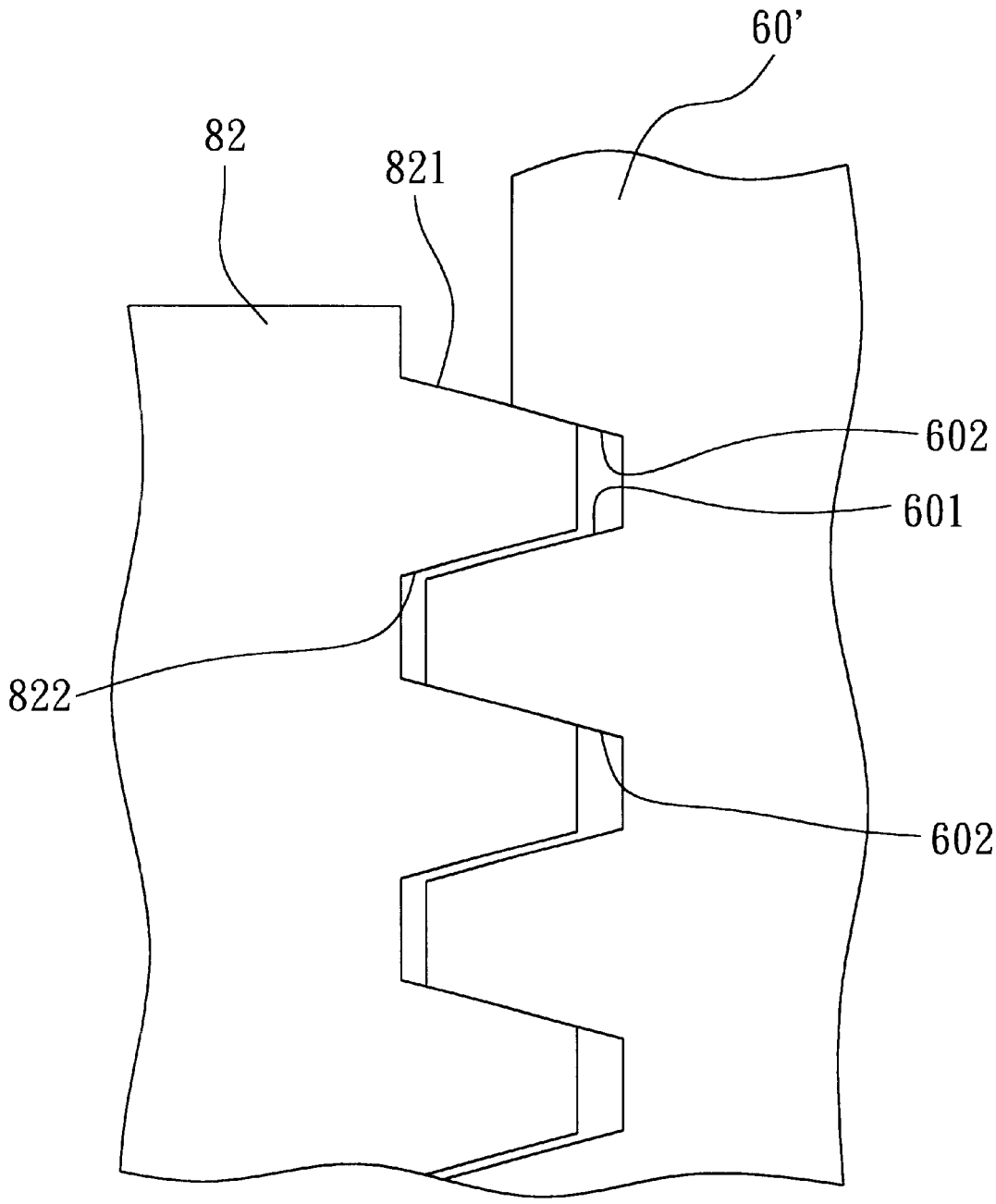
Figure 9A:
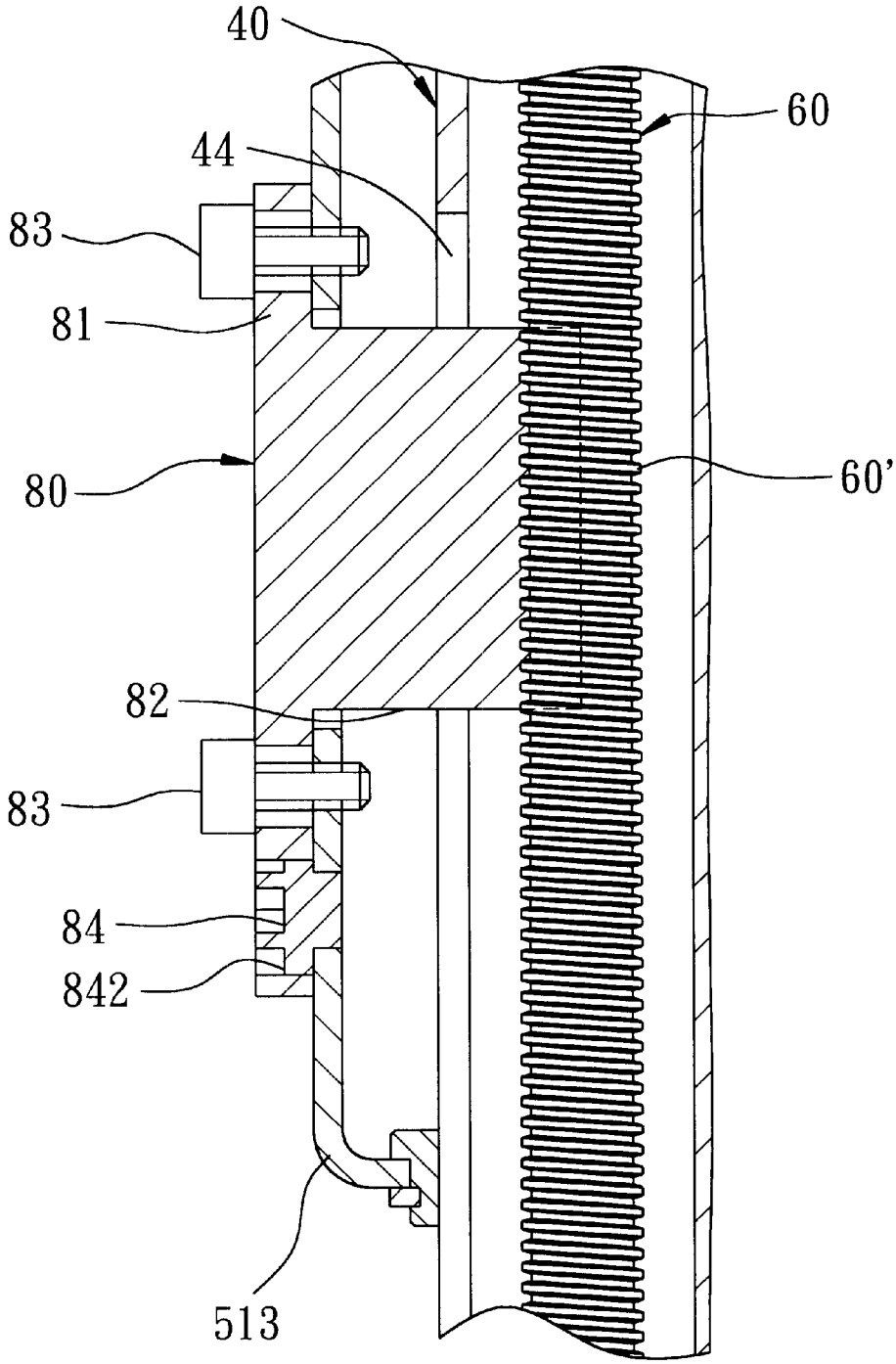
FIGS. 9A to 9C are partly fragmentary views to illustrate the eccentric member in a second engaging position with respective to the threaded member.
Figure 9B:
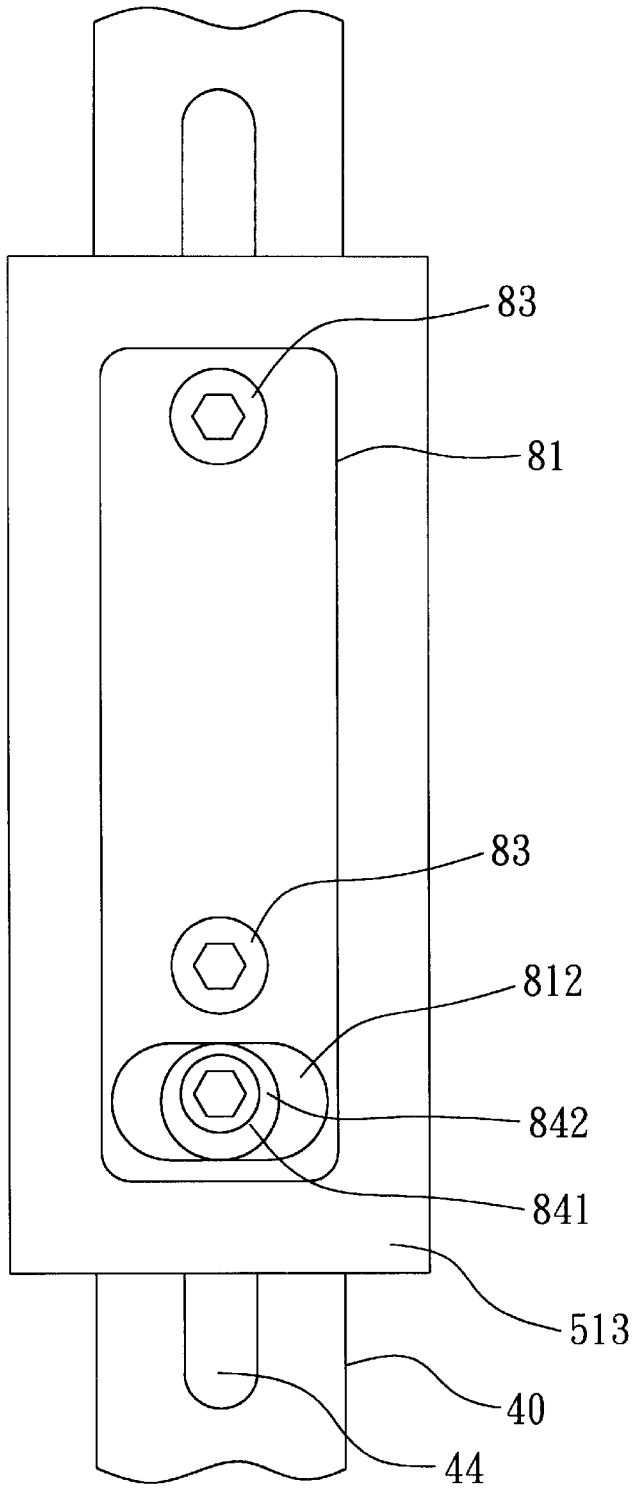
Figure 9C:
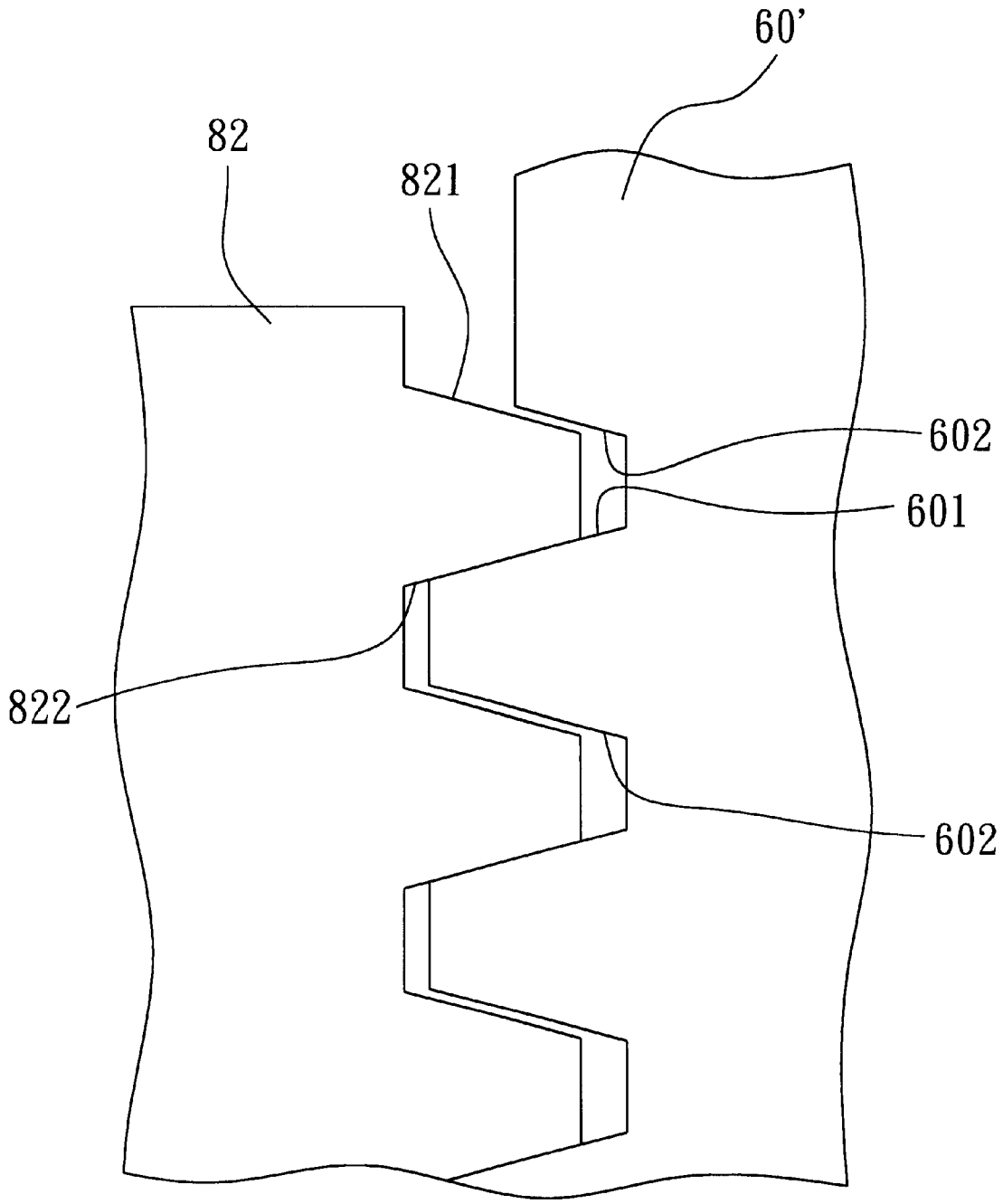

Referring to FIGS. 8A to 8C and 9A to 9C, in combination with FIGS. 4, 5 and 7, a tightening unit is provided for tightening the cutter carriage 50 on the screw rods 60. The tightening unit includes four eccentric members 84 that are mounted rotatably and respectively on the bracket plates 81 of the threaded members 80. Each of the eccentric members 84 includes a rotatable shaft 841 and an eccentric wheel 842 that extends radially from and that is eccentric relative to the rotatable shaft 841, that is inserted in and that constantly and rotatably engages the top and bottom wall portions 8131, 8132 of the hole-confining wall 813 of the bracket plate 81 of a respective one of the threaded members 80, and that is rotatable together with the rotatable shaft 841 between a first engaging position (see FIGS. 8A and 8B), in which, the eccentric wheel 842 moves the respective one of the threaded members 80 upwardly relative to a respective one of the screw rods 60 so as to permit engagement between the upper helical surface 821 of the threaded portion 82 of the respective one of the threaded members 80 and the lower helical surface 602 of the engaging portion 60' of the respective one of the screw rods 60 (see FIG. 8C), and a second engaging position (see FIGS. 9A and 9B), in which, the eccentric wheel 842 moves the respective one of the threaded members 80 downwardly relative to the respective one of the screw rods 60 so as to permit engagement between the lower helical surface 822 of the threaded portion 82 of the respective one of the threaded members 80 and the upper helical surface 601 of the engaging portion 60' of the respective one of the screw rods 60 (see FIG. 9C).

Preferably, the eccentric wheels 842 of two diagonally disposed ones of the threaded members 80 are positioned at the first engaging position, and the eccentric wheels 842 of the other two diagonally disposed ones of the threaded members 80 are positioned at the second engaging position so as to permit tightening of the cutter carriage 50 on the screw rods 60 and so as to eliminate vibration of the cutter carriage and clashing between the castings of the cutter carriage and the screw rods as encountered in the prior art, which, in turn, can alleviate the precision problem that results from the vibration of the cutter carriage.

With the invention thus explained, it is apparent that various modifications and variations can be made without departing from the spirit of the present invention. It is therefore intended that the invention be limited only as recited in the appended claims.

I claim:

1. A wood planing machine comprising:

a generally rectangular base having four corners;

four parallel hollow posts that extend upright from said four corners of said base, respectively, and that are formed with elongated slots extending along lengths of said posts, respectively;

four screw rods respectively disposed in said posts, and rotatable about axes defined by said screw rods, each of said screw rods including an engaging portion accessible via said slot in the respective one of said posts, said engaging portion having upper and lower helical surfaces;

four sprockets disposed underneath said base and connected respectively to bottom ends of said screw rods;

a chain engaging said sprockets so as to synchronize rotations of said screw rods;

a cutter carriage including a pair of parallel carriage seats, each of which is transverse to and is mounted movably on two adjacent ones of said posts, and each of which includes top and bottom plates and two opposite side plates that interconnect said top and bottom plates and that are respectively formed with openings confronting said slots in the respective ones of said posts;

four threaded members mounted respectively on said side plates of said carriage seats, each of said threaded members including a bracket plate mounted adjustably on a respective one of said side plates, and a sector-shaped threaded portion projecting from said bracket plate through said opening in the respective one of said side plates to threadedly engage said engaging portion of a respective one of said screw rods so as to permit said carriage seats to be moved simultaneously along said posts when said screw rods rotate synchronously, said bracket plate of each of said threaded members being formed with an engaging hole defined by a hole-confining wall, said threaded portion of each of said threaded members having upper and lower helical surfaces, said hole-confining wall of said bracket plate of each of said threaded members having top and bottom wall portions; and a tightening unit including four eccentric members that are mounted rotatably and respectively on said bracket plates of said threaded members, each of said eccentric members including a rotatable shaft and an eccentric wheel that extends radially from and that is eccentric relative to said rotatable shaft, that is inserted in and that constantly and rotatably engages said top and bottom wall portions of said hole-confining wall of said bracket plate of a respective one of said threaded members, and that is rotatable together with said rotatable shaft between a first engaging position, in which, said eccentric wheel moves the respective one of said threaded members upwardly relative to a respective one of said screw rods so as to permit engagement between said upper helical surface of said threaded portion of the respective one of said threaded members and said lower helical surface of said engaging portion of the respective one of said screw rods, and a second engaging position, in which, said eccentric wheel moves the respective one of said threaded members downwardly relative to the respective one of said screw rods so as to permit engagement between said lower helical surface of said threaded portion of the respective one of said threaded members and said upper helical surface of said engaging portion of the respective one of said screw rods.

2. The wood planing machine of claim 1, wherein said eccentric wheels of two diagonally disposed ones of said threaded members are positioned at said first engaging position, and said eccentric wheels of the other two diagonally disposed ones of said threaded members are positioned at said second engaging position so as to permit tightening of said cutter carriage on said screw rods and so as to eliminate clashing between said threaded members and said screw rods.

* * * * *

UNITED STATES PATENT AND TRADEMARK OFFICE

CERTIFICATE OF CORRECTION

PATENT NO. : 6,427,734 B1
DATED : August 6, 2002
INVENTOR(S) : Pei-Lieh Chiang

It is certified that error appears in the above-identified patent and that said Letters Patent is hereby corrected as shown below:

Title page,
Item [63], delete "No. 09/824,501, filed on Apr. 2, 2001, which is a continuation-in-part of application".

Column 1,
Line 6, after "of" insert -- co-pending -- and "patent" should read -- Patent --.
Lines 7-8, "application Ser. No. 09/824,501, filed Apr. 2, 2001 which is a CIP of" should read -- Application -- and "and" should read -- , which --.

Signed and Sealed this

Third Day of December, 2002

JAMES E. ROGAN
*Director of the United States Patent and Trademark Office*